US011345492B2

(12) United States Patent
De Heer

(10) Patent No.: US 11,345,492 B2
(45) Date of Patent: May 31, 2022

(54) PACKAGING PROCESS AND APPARATUS

(71) Applicant: INGENIEURSBURO J.K. DE HEER, Purmer (NL)

(72) Inventor: Jan Kees De Heer, Purmer (NL)

(73) Assignee: INGENIEURSBURO J.K. DE HEER, Purmer (NL)

( * ) Notice: Subject to any disclaimer, the term of this patent is extended or adjusted under 35 U.S.C. 154(b) by 201 days.

(21) Appl. No.: 16/484,320

(22) PCT Filed: Feb. 7, 2018

(86) PCT No.: PCT/NL2018/050085
§ 371 (c)(1),
(2) Date: Aug. 7, 2019

(87) PCT Pub. No.: WO2018/147732
PCT Pub. Date: Aug. 16, 2018

(65) Prior Publication Data

US 2019/0375522 A1 Dec. 12, 2019

(30) Foreign Application Priority Data

Feb. 8, 2017 (NL) ..... 2018341

(51) Int. Cl.
*B65B 9/13* (2006.01)
*B65B 9/20* (2012.01)
(Continued)

(52) U.S. Cl.
CPC ..... *B65B 9/13* (2013.01); *B65B 9/2007* (2013.01); *B65B 9/22* (2013.01); *B65B 41/16* (2013.01)

(58) Field of Classification Search
CPC ..... B65B 9/00; B65B 9/06–13; B65B 9/20; B65B 9/2014; B65B 9/2028;
(Continued)

(56) References Cited

U.S. PATENT DOCUMENTS 3,703,252 A 11/1972 Silvandersson
3,778,961 A 12/1973 Lesher
(Continued)

FOREIGN PATENT DOCUMENTS

AR 202734 A1 7/1975
CN 101636322 A 1/2010
(Continued)

OTHER PUBLICATIONS

European Patent Office (ISA), International Search Report and Written Opinion for International Application No. PCT/NL2018/050085, dated Jul. 13, 2018.

*Primary Examiner* — Chelsea E Stinson
(74) *Attorney, Agent, or Firm* — Honigman LLP

(57) ABSTRACT

An apparatus and process for packaging a product, such as a waste product, in a sealed tubular plastic container involves providing a source of a sheet of a plastic film and moving a portion of the film away from the source and about an open-ended, vertically-extending tubular pipe. The film is then moved toward an open top end of the pipe to form a second portion of the film into a tubular form around the pipe with the second widthwise end portions overlapping each other. The overlapping portions are sealed and the tubular form of the film is moved into an open top end of the pipe, so that the interior of the tube, formed by the film is open at the top of the pipe to receive the product. The product may then be transported downwardly through the tube, which is then sealed above and below the encapsulated product.

10 Claims, 8 Drawing Sheets

(51) Int. Cl.
*B65B 9/22* (2006.01)
*B65B 41/16* (2006.01)

(58) Field of Classification Search
CPC ..... B65B 9/2035; B65B 9/207; B65B 9/213; B65B 9/22; B65B 41/00; B65B 41/12; B65B 41/16
USPC ..... 53/451
See application file for complete search history.

(56) References Cited

U.S. PATENT DOCUMENTS

| | | | | |
|---|---|---|---|---|
| 3,779,861 | A | 12/1973 | Jones | |
| 4,848,063 | A * | 7/1989 | Niske | B65B 61/24 53/451 |
| 5,813,964 | A * | 9/1998 | Motomura | B65B 9/20 493/302 |
| 6,428,457 | B1 | 8/2002 | Fukuda et al. | |
| 8,707,662 | B2 * | 4/2014 | Borsari | B29C 65/3656 53/550 |
| 11,104,462 | B2 * | 8/2021 | Costa | B65B 41/16 |
| 2015/0151908 | A1 | 6/2015 | Schofield et al. | |

FOREIGN PATENT DOCUMENTS

| | | | |
|---|---|---|---|
| EP | 0699584 | A2 | 3/1996 |
| EP | 0850836 | A1 | 7/1998 |
| EP | 2441684 | A2 | 4/2012 |
| EP | 2631200 | A1 | 8/2013 |
| GB | 1482910 | A | 8/1977 |
| GB | 2206094 | A | 12/1988 |
| GB | 2510277 | A | 7/2014 |
| WO | WO-02/20354 | A1 | 3/2002 |

* cited by examiner

PACKAGING PROCESS AND APPARATUS

CROSS-REFERENCE TO RELATED APPLICATIONS

This application is a National Phase Application of International Application PCT/NL2018/050085, filed Feb. 7, 2018, which claims priority to Dutch Patent Application No. 2018341, filed Feb. 8, 2017, the disclosures of which are incorporated herein by reference in their entirety.

TECHNICAL FIELD

The present disclosure pertains to a process and apparatus for packaging a product, such as a waste product, in a sealed tubular container. The content of the disclosure also pertains to packaging a product in a container formed by one or more, heat bonded plastic sheets, and in some implementations just one heat bonded plastic sheet. The disclosure further pertains to packaging a product in a container heat that is sealed against leakage of its contents, such as leakage of liquid and gaseous contents.

BACKGROUND

In order to dispose safely of waste products, such as used disposable diapers, bandages and feminine hygiene products (e.g., tampons and sanitary napkins), ways have been sought for enabling individuals to enclose each product, produced by the individuals, in a container that can then be easily and safely collected and stored and then transported as a plurality of containers to a centralized waste disposal facility. In particular, ways have been sought for enabling individuals to enclose each product in a container, from which solids (including microorganisms), liquids and gases cannot escape or leak while a plurality of containers is being collected, stored, transported and disposed of.

SUMMARY

In one aspect of the present disclosure, a process for enclosing a product, such as a waste product, in a finally-sealed tubular plastic container includes providing a source, such as a roll, of a sheet of a plastic, such as thermoplastic, film. The sheet has a first lengthwise portion and a second lengthwise portion, which is spaced lengthwise away from the first lengthwise portion with a pair of second widthwise end portions on opposite sides of the second lengthwise portion. The sheet further includes a third lengthwise portion, which is spaced lengthwise further away from the first lengthwise portion than the second lengthwise portion. The third lengthwise portion may have a tubular form and opposite widthwise sides of which have been heat sealed together, such as along substantially the entire connection of the second and third lengthwise portions. The second lengthwise portion of the sheet may be moved away from the source and about an open-ended, vertically-extending tubular pipe and then toward an open top end of the pipe to form the second lengthwise portion of the sheet into a tubular form around the pipe with the second widthwise end portions overlapping each other. The overlapping second widthwise end portions of the second lengthwise portion of the sheet may be sealed to each other, such as by heat sealing, to form the second lengthwise portion of the sheet into a plastic tube with the pipe at an interior of the tube. The sealing may be done while pressing the overlapping second widthwise end portions against an exterior surface of the pipe. The tube, formed by the second lengthwise portion of the sheet, may be moved into an open top end of the pipe, such as with first opposed rotating rollers that are on opposite sides of, frictionally engage, the tube, and then downwardly through the pipe, so that the interior of the tube, formed by the second lengthwise portion of the sheet, is open at the top end of the pipe. The product may be placed into the interior of the tube, formed by the second lengthwise portion of the sheet, at the open top end of the pipe, so that the product then falls or is transported downwardly through the tube, formed by the second lengthwise portion of the sheet, and the pipe to the heat sealed top of the third lengthwise portion of the sheet. The tube, formed by the second lengthwise portion of the sheet, may be moved further downwardly through, and outwardly of, the pipe, such as with second opposed rotating rollers that are on opposite sides of, frictionally engage, the tube. The opposite widthwise sides of the top portions of the tube, formed by the second lengthwise portion of the sheet, may be sealed, such as by heat sealing, along the top of the tube, such as along substantially the entire width of the top of the tube formed by the second lengthwise portion of the sheet, to enclose the product in the tube.

Optionally, the process may also include the step of engaging the product in the tube, formed by the second lengthwise portion of the sheet, after the tube is moved downwardly through the pipe, between third opposed rotating rollers that are above the second rollers and that have mating semi-circular apertures, which may be centered along the length of the third rollers and which urge the product to move downwardly in the tube with rotation of the third rollers. Also, the third rollers may be biased, such as spring biased, against opposite widthwise sides of the tube, so that the third rollers and their apertures can reversibly move widthwise apart when urged by the size of the product in the tube between the third rollers.

In another aspect of the disclosure, an apparatus for enclosing a product, such as a waste product, in a finally-sealed tubular plastic container includes a source, such as a roll, of a sheet of a plastic, such as thermoplastic, film having a first lengthwise portion. The sheet also includes a second lengthwise portion, spaced lengthwise away from the first lengthwise portion, with a pair of second widthwise end portions on opposite sides of the second lengthwise portion. The sheet further includes a third lengthwise portion, which is spaced lengthwise further away from the first lengthwise portion than the second lengthwise portion, which has a tubular form and opposite widthwise sides of which have been heat sealed together along substantially the entire width of the top of the third lengthwise portion. The apparatus also may have an open-ended, vertically-extending tubular pipe adjacent to the source. A mandrel may be disposed between an outer surface of the pipe and the source, which may be adapted to form the second lengthwise portion of the sheet into a tubular form around the pipe with the second widthwise end portions overlapping each other when the second lengthwise portion is moved away from the source along the mandrel toward the outer surface of the pipe and then toward an open top end of the pipe. A first sealing device may be disposed adjacent to an exterior surface of the pipe for sealing, such as heat sealing, to each other the overlapping second widthwise end portions of the tubular form of the second lengthwise portion of the sheet, such as while pressing the overlapping second widthwise end portions against the exterior surface of the pipe, to form the tubular form of the second lengthwise portion of the sheet into a plastic tube with the pipe at an interior of the tube. Also, the apparatus may include first opposed rotating rollers that are on opposite widthwise sides of, and frictionally engage, the exterior of the tube, formed by the second lengthwise portion of the sheet, and that are adapted to move the tube toward an open top end of the pipe. Further, second opposed rotating rollers may be included that are on opposite widthwise sides of, and frictionally engage, plastic tubes formed by the second and third lengthwise portions of the sheet, that are below an open bottom end of the pipe, and that are adapted to move the second and third lengthwise portions downwardly and thereby move the tube, formed by the second lengthwise portion of the sheet, into the open top end of the pipe and then downwardly in the pipe to and through the open bottom end of the pipe, so that the interior of the tube, formed by the second lengthwise portion of the sheet, is open at the top end of the pipe. A second sealing device may be disposed below the pipe for sealing, such as heat sealing, to each other, opposite widthwise sides of top portions of the tube, formed by the second lengthwise portion of the sheet, along substantially the entire width of top portions of the tube, formed by the second lengthwise portion of the sheet, and thereby enclose a product in the tube.

In some implementations, the apparatus may also include third opposed rotating rollers that are above the second rollers and that are on opposite width wise sides of, and may contact, the tube, formed by the second lengthwise portion of the sheet, after it moves downwardly in the pipe. The third rollers may be adapted to move any product within the tube downwardly out of, and away from, the bottom of the pipe. The third rollers may have mating semi-circular apertures which may be centered along the length of the third rollers to engage the product as it passes downwardly in the tube between the third rollers. The apertures in the third rollers may urge the product to move downwardly in the tube with rotation of the third rollers. Also, the third rollers may be biased, such as spring biased, against opposite widthwise sides of the tube, so that the third rollers and their apertures can reversibly move widthwise apart when urged by the size of the product in the tube between the third rollers.

In yet another aspect of the disclosure, an apparatus for enclosing a product, such as a waste product, in a finally-sealed tubular plastic container includes an open-ended, vertically-extending tubular pipe. The apparatus may also include a source of a tube of a plastic, such as a thermoplastic, extending downwardly in the pipe from an open top end of the pipe to and through an open bottom end of the pipe. An interior of the tube may be open at the top end of the pipe for insertion of a product into the interior of the tube. First opposed rotating rollers may be disposed on opposite widthwise sides of, and frictionally engage, the tube, that are below an open bottom end of the pipe, and that are adapted to move the tube downwardly in the pipe. Second opposed rotating rollers may be positioned above the first rollers and on opposite widthwise sides of, and contact, the tube. The third rollers may be adapted to move the product within the tube downwardly out of, and away from, the bottom of the pipe. The third rollers may have mating semi-circular apertures which are advantageously centered along the length of the third rollers to engage the product as it passes downwardly in the tube between the second rollers. The apertures in the second rollers may urge the product to move downwardly in the tube with rotation of the second rollers. A sealing device may be disposed below the pipe for sealing, such as heat sealing, to each other, opposite widthwise sides of top portions of the tube to thereby enclose the product in the tube.

DETAILED DESCRIPTION

In accordance with this disclosure, the term "sheet" may refer to a thin continuous sheet of a plastic film or foil, such as a film or foil that can be heat sealed to itself to provide a liquid and gas barrier around about a product, such as a waste product. In some implementations, the sheet may include a thermoplastic film, such as a sheet made from polyolefins, more specifically Polyethylene or polypropylene, and more specifically LDPE, or polyesters, and/or sheets coated with heat or pressure activatible adhesives. The sheet extends lengthwise, i.e., along the length of the sheet, from a substantially continuous source, such as a roll of the film.

Herein, the term "product" may refer to any organic product with a biologic or liquid or gaseous content which is to be contained. A product can be any compressible solid product, such as a food product, e.g., a meat or dairy product. The term "waste product" includes any disposable diaper, bandage, feminine hygiene product (e.g., a tampon or sanitary napkin), or used medical supplies and clinical waste products, such as waste bandages, swabs, bandages, dressings, gloves, sheets, and the like.

The apparatus 10 disclosed herein can be used for packaging a plurality of individual products, such as waste products, in a sheet 14 of a plastic, such as thermoplastic, film. With the apparatus 10, the sheet 14 is formed into a continuous, generally tubular structure 16 of discrete tubular plastic containers 18, each holding and safely enclosing one or more products against leakage.

Figure 1:
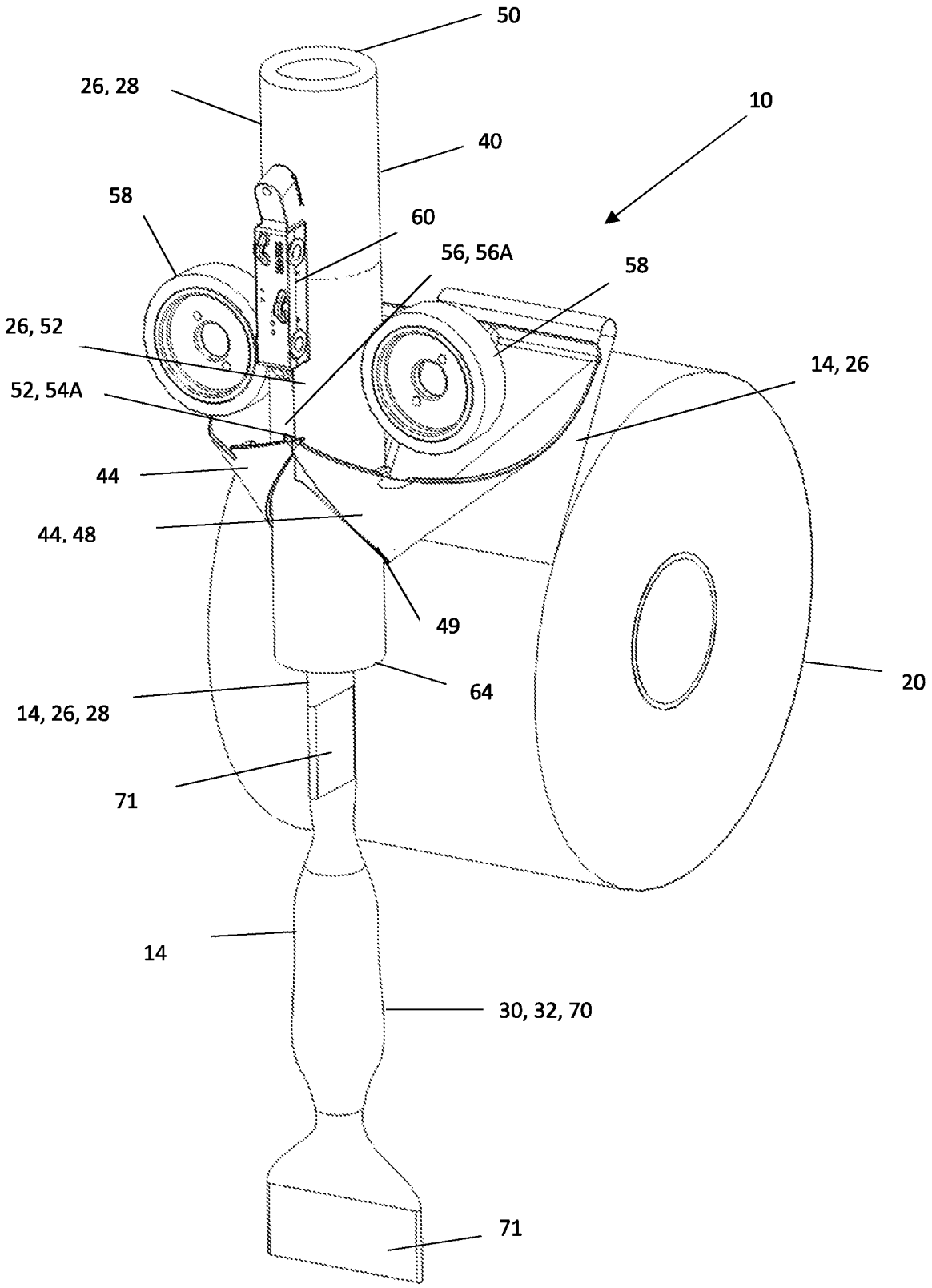
FIG. 1 is a perspective view of a packaging apparatus, from one side of the apparatus, with lower portions of the apparatus removed; shown is a plastic film that extends from a roll of the film, over a forming shoulder, along a lower forming surface of a mandrel, then about an outer tubular surface of an open-ended, vertically-extending pipe, then upwardly around the pipe and past a first pair of opposed rollers in a tubular form and past a first heat sealing device, then inwardly of the open top end of the pipe as a plastic tube, then downwardly in the pipe and then outwardly of the pipe through its open bottom end as a string of finally-sealed tubular plastic containers, each containing a product which cannot leak out of its container.
Figure 2:
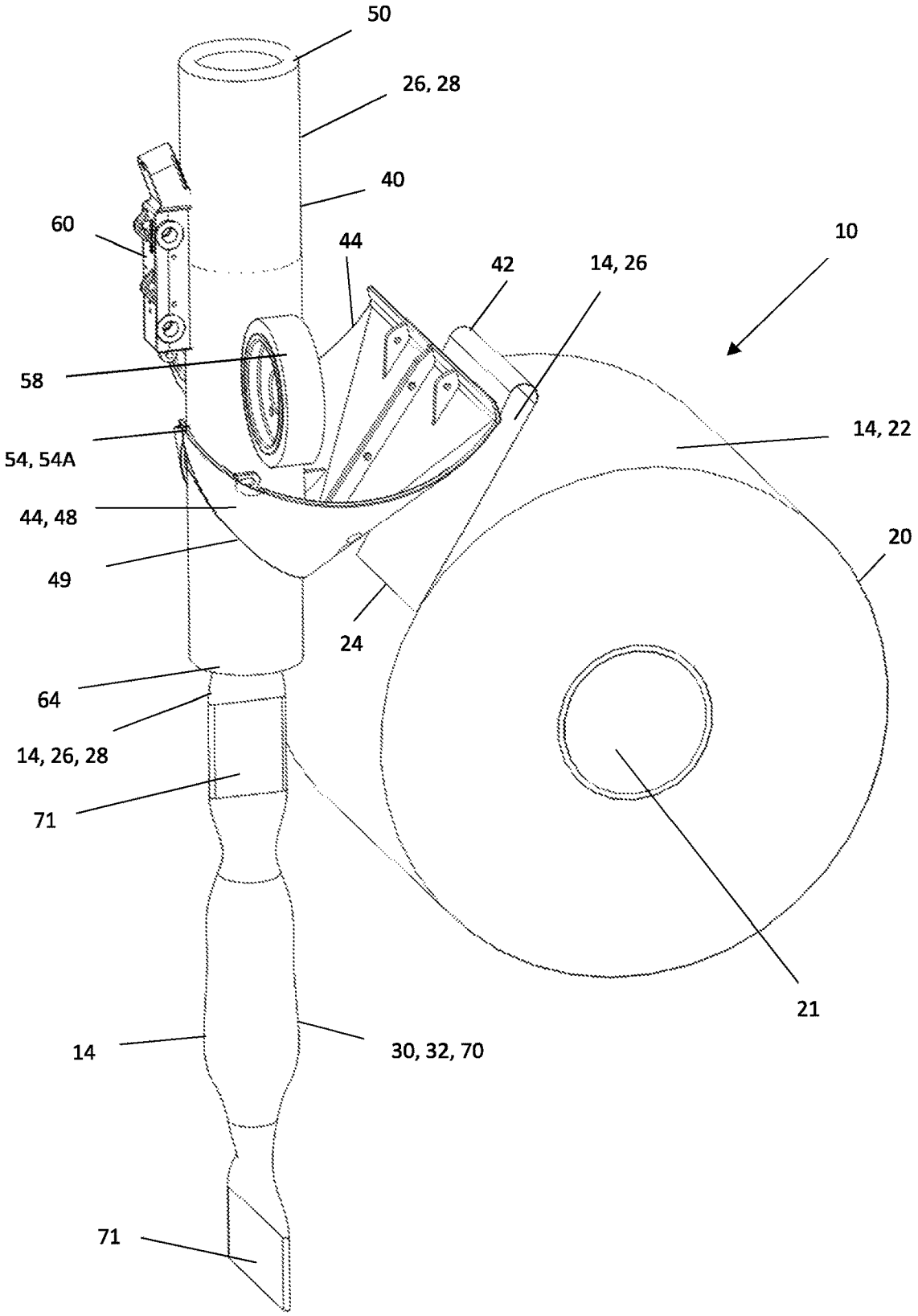
FIG. 2 is a perspective view of the apparatus of FIG. 1 from an opposite side of the apparatus, with lower portions of the apparatus removed.
Figure 3:
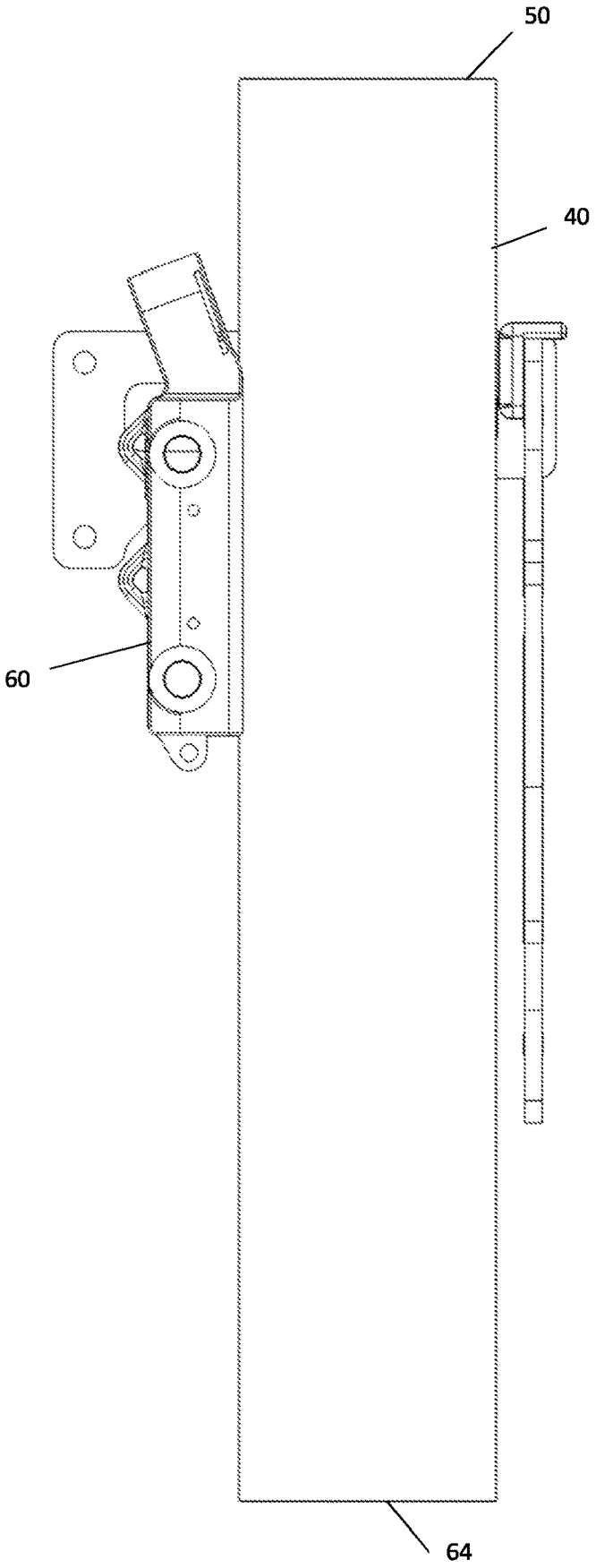
FIG. 3 is a plan view of a part of the upper portions of the apparatus of FIG. 1, showing the vertically-extending pipe and the first heat sealing device adjacent the outer surface of the pipe.
Figure 4:
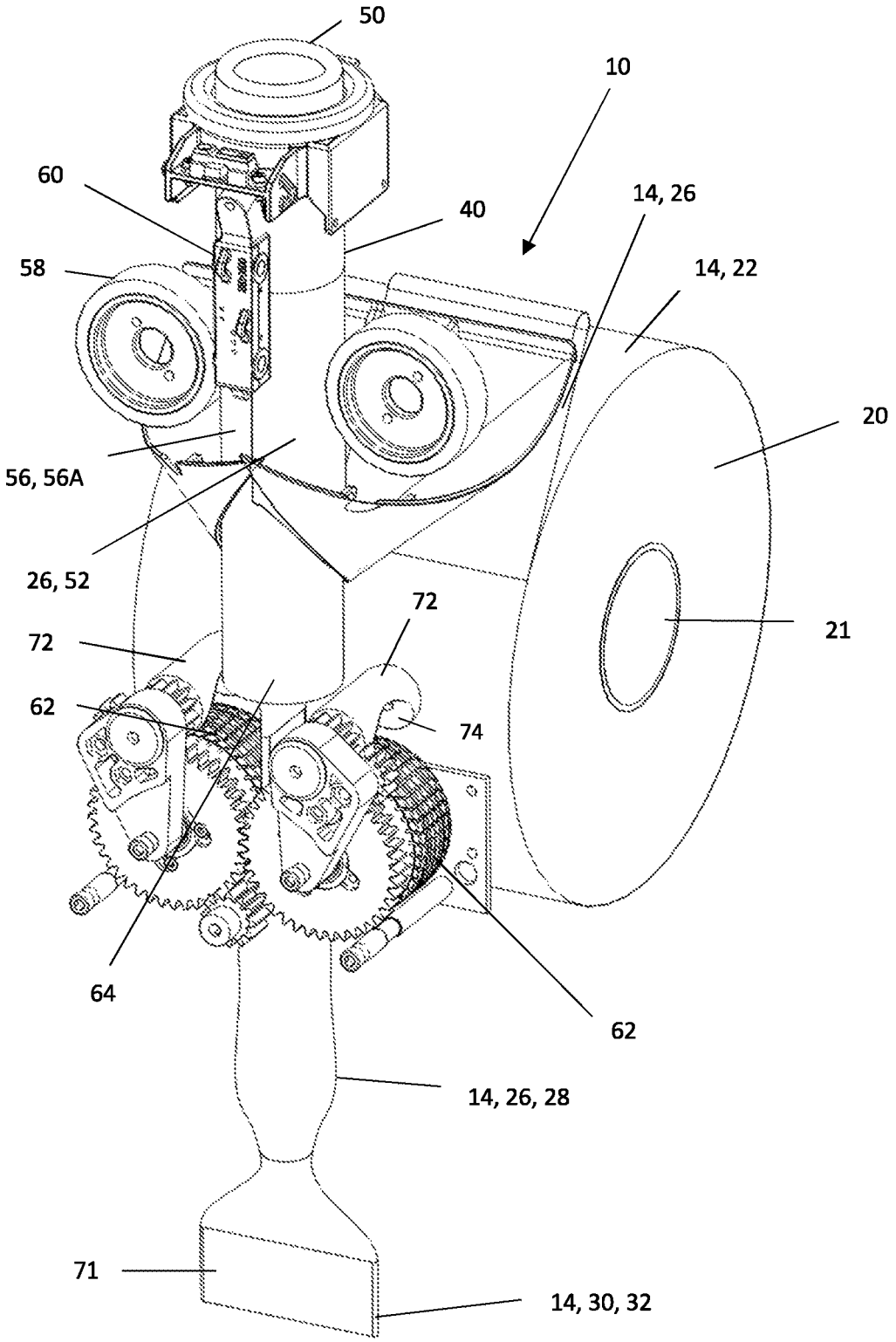
FIG. 4 is a perspective view of a packaging apparatus, showing lower portions of the apparatus, below the open bottom end of its pipe: particularly shown are opposed second and third pairs of rollers for moving a plastic tube downwardly from the open bottom end of the pipe.
Figure 5:
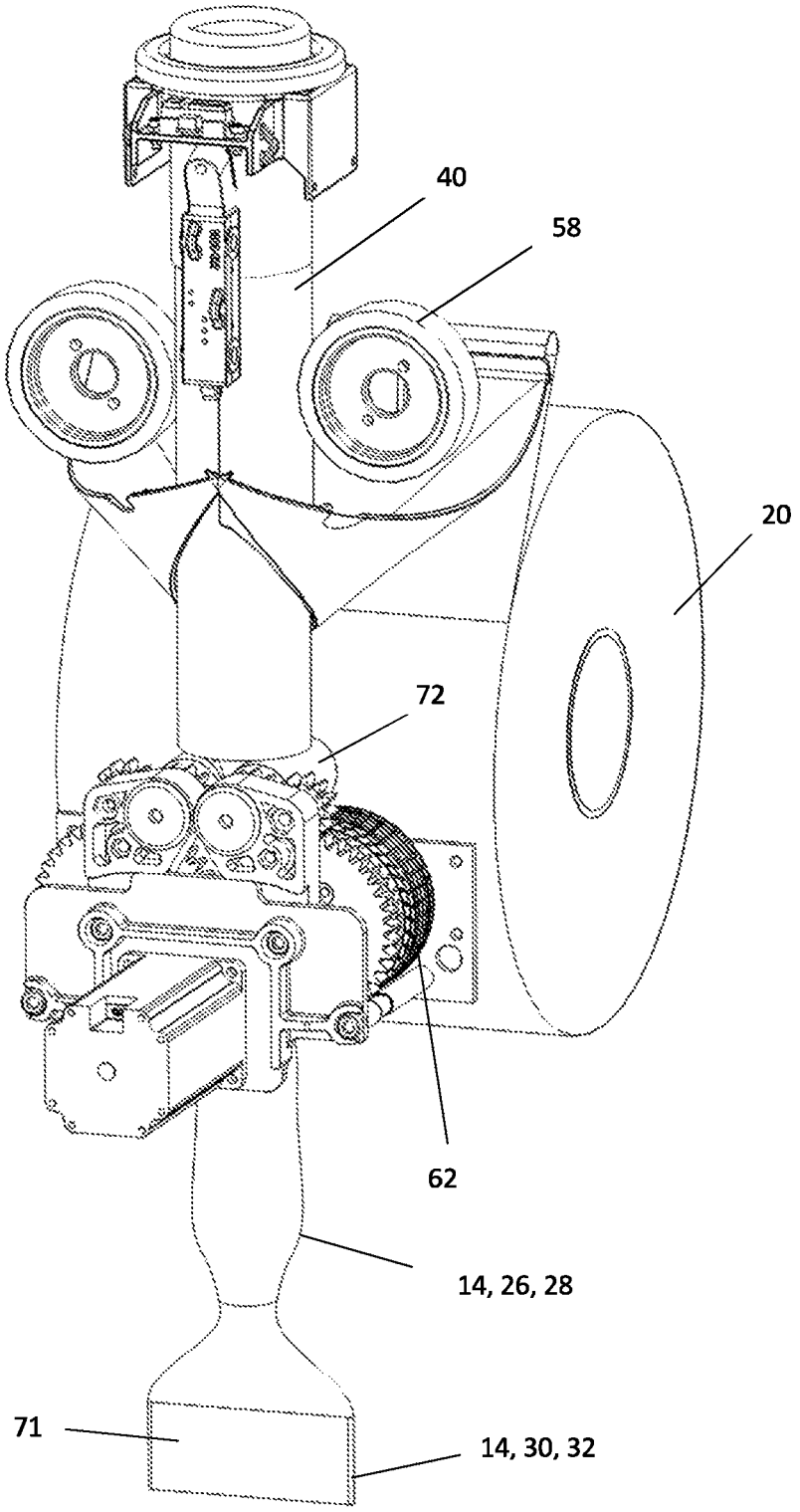
FIG. 5 is a perspective view of a packaging apparatus, including a housing for a motor for driving the second and third pairs of opposed rollers.
Figure 6:
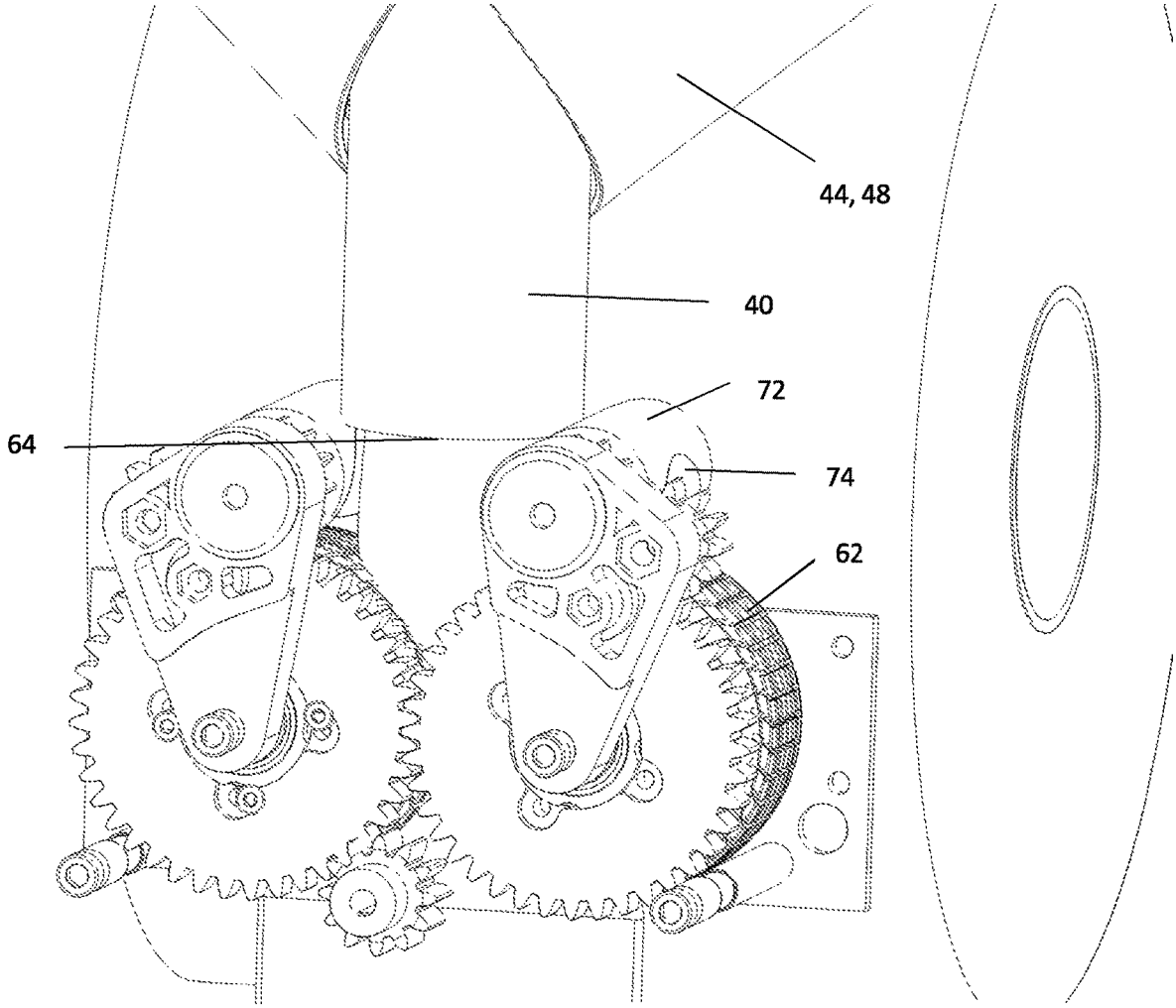
FIG. 6 is a close-up perspective view of a packaging apparatus, showing the second and third pairs of opposed rollers of the apparatus.

As shown in FIGS. 1, 2 and 4, the apparatus 10 includes a source 20 of a substantial continuous length of the sheet 14 of the plastic film. The source of the sheet of the film is a roll 20 of the sheet 14, wound about a central axis or core 21. However, in additional implementations, other sources of the sheet of the film can be used, such as an extruder of a continuous flat sheet of the film or a pleated stack of flat sheets of the film.

In the apparatus 10, as shown in FIGS. 1, 2 and 4, a first lengthwise portion 22 of the sheet 14 may be wound about the roll 20, with a free lengthwise end 24 extending lengthwise away (along the sheet 14) from the roll 20 to a second lengthwise portion 26 of the sheet. The apparatus forms the second lengthwise portion 26 of the sheet 14 into a plastic tube 28 for a product to be packaged, as the sheet 14 on the roll 20 is unwound and the second lengthwise portion 26 of the sheet is moved away from the roll by the process of the apparatus. The second lengthwise portion 26 of the sheet extends lengthwise away (along the sheet 14) from the first lengthwise portion 22 and the roll 20 to a third lengthwise portion 30 of the sheet 14. The third lengthwise portion 30 of the sheet extends lengthwise away (along the sheet 14) from the first and second lengthwise portions 22, 26 of the sheet 14 and is further lengthwise from the first lengthwise portion 22 and from the roll 20 than the second lengthwise portion 26. The apparatus previously formed the third lengthwise portion 30 into a previous plastic tube 32 for a previous product to be packaged, as the sheet 14 on the roll 20 was previously unwound and the third lengthwise portion 30 was moved away from the roll 20. In this regard, the opposite widthwise sides of the previous plastic tube 32 have been heat sealed together along substantially the entire connection of the second and third lengthwise portions 26, 30.

As the sheet 14 is unwound from the roll 20 in the apparatus 10, the second lengthwise portion 26 of the sheet may be moved lengthwise away from the roll and upwardly towards an open-ended, vertically-extending tubular pipe 40 adjacent to the roll. In this regard, the second lengthwise portion 26 is moved initially up to and over a forming shoulder 42, extending widthwise relative to the sheet 14, and then moved downwardly beneath a pair of identical mandrels 44. The mandrels 44 are adjacent to, and surround, the tubular outer surface 46 of the pipe 40 and extend lengthwise away from the forming shoulder 42. The mandrels 44 are symmetrical widthwise, relative to the sheet 14, about the pipe 40, and each has a lower forming surface 48, against which the second lengthwise portion 26 of the sheet is moved downwardly from the forming shoulder 42 toward the bottom 49 of the lower forming surface 48 of each mandrel 44 to the tubular outer surface 46 of the pipe 40. At the bottom 49 of the lower forming surfaces 48 of the mandrels 44, the second lengthwise portion 26 of the sheet is moved upwardly around the pipe 40, towards its open top end 50, whereby the second lengthwise portion 26 is provided with a tubular form 52 around, and adjacent to, the outer surface 46 of the pipe. The widthwise bottom ends 54, 54A of the mandrels 44 overlap, so that the widthwise end portions 56, 56A on opposite sides of the second lengthwise portion 26 of the sheet 14 are symmetrical about the pipe and overlap in the tubular form 52 of the second lengthwise portion 26 around the pipe.

Adjacent to the tubular outer surface 46 of the pipe 40 are a first pair of opposed rotating mating rollers 58. The first rollers 58 rotate widthwise on opposite widthwise sides of, and frictionally engage, the exterior of the tubular form 52 of the second lengthwise portion 26 of the sheet 14. The first rollers 58 are adapted to move the tubular form 52 of the second lengthwise portion 26 from the bottom 49 of the lower forming surfaces 48 of the mandrels 44 toward the open top end 50 of the pipe.

Also, a downwardly-elongated first heating device 60 may be provided adjacent to the tubular outer surface 46 of the pipe 40, such as above the rollers 58. The first heating device 60 heat seals the overlapping widthwise end portions 56, 56A of the second lengthwise portion 26 of the sheet 14 to each other. Thereby, the first heating device 60 may at least partially make the tubular form 52 of the second lengthwise portion 26 of the sheet 14 into the plastic tube 28 with the pipe 40 at the interior of the tube. In some implementations, the first heating device 60 has a downwardly-extending, heated electric wire that continuously contacts the overlapping widthwise end portions 56, 56A as the second lengthwise portion 26 of the sheet 14 is moved upwardly from the bottom of the lower forming surfaces 48 of the mandrels 44 toward the open top end 50 of the pipe. Optionally, the first heating device 60 may press the overlapping widthwise end portions 56, 56A against the outer surface 46 of the pipe to enhance the heat seal of the tube 28.

In the apparatus 10, as shown in FIGS. 4-8, the plastic tube 28, formed by the second lengthwise portion 26 of the sheet 14, may be pulled into the open top end 50 of the pipe 40 and then pulled downwardly in the pipe to and through the open bottom end 64 of the pipe, so that the interior of the tube 28 is open at the top end 50 of the pipe. This is accomplished by a second pair of opposed rotating mating rollers 62, which may be made of a soft rubber or plastic, where the second rollers 62 rotate widthwise beneath the open bottom end 64 of the pipe 40. The second rollers 62 may be on opposite widthwise sides of, and frictionally engage, the lengthwise end of the tube 28 formed by the second lengthwise portion 26 and the previous plastic tube 32 of the third lengthwise portion 28 of the sheet 14, containing the previous product. Thereby, the product can be inserted into the interior of the tube 28, formed by the second lengthwise portion 26 of the sheet 14, where the tube 28 is open at the top end 50 of the pipe 40. Then, the product can fall downwardly within the tube 28 until it reaches the sealed top of the previous plastic tube 32 of the third lengthwise portion 28 of the sheet 14.

Figure 7:
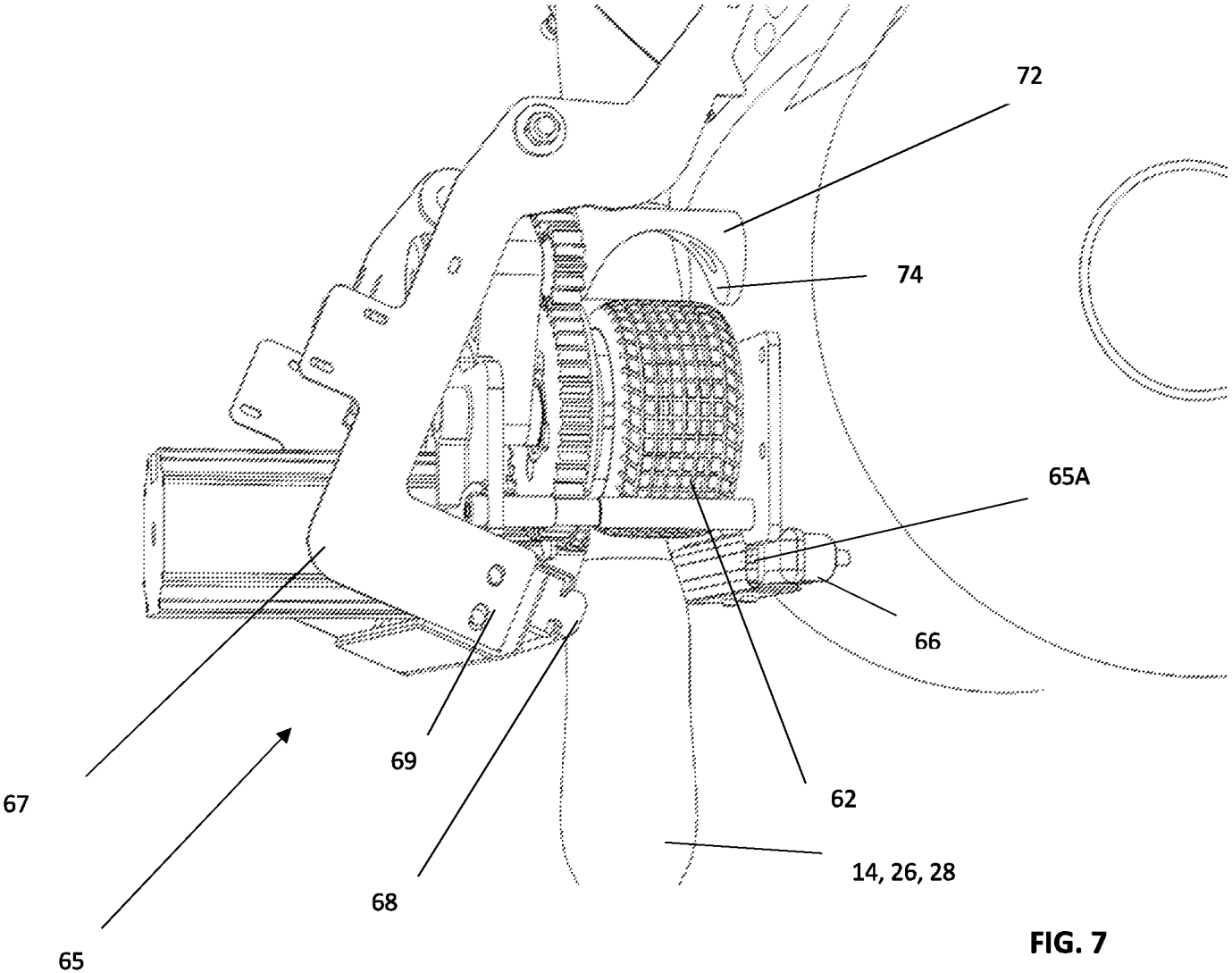
FIG. 7 is a close-up perspective view, showing the second and third pairs of opposed rollers and a second heat sealing device of the packaging apparatus; particularly shown is the movable arm of the second heat sealing device in an open position, away from the device's heated electric wire.
Figure 8:
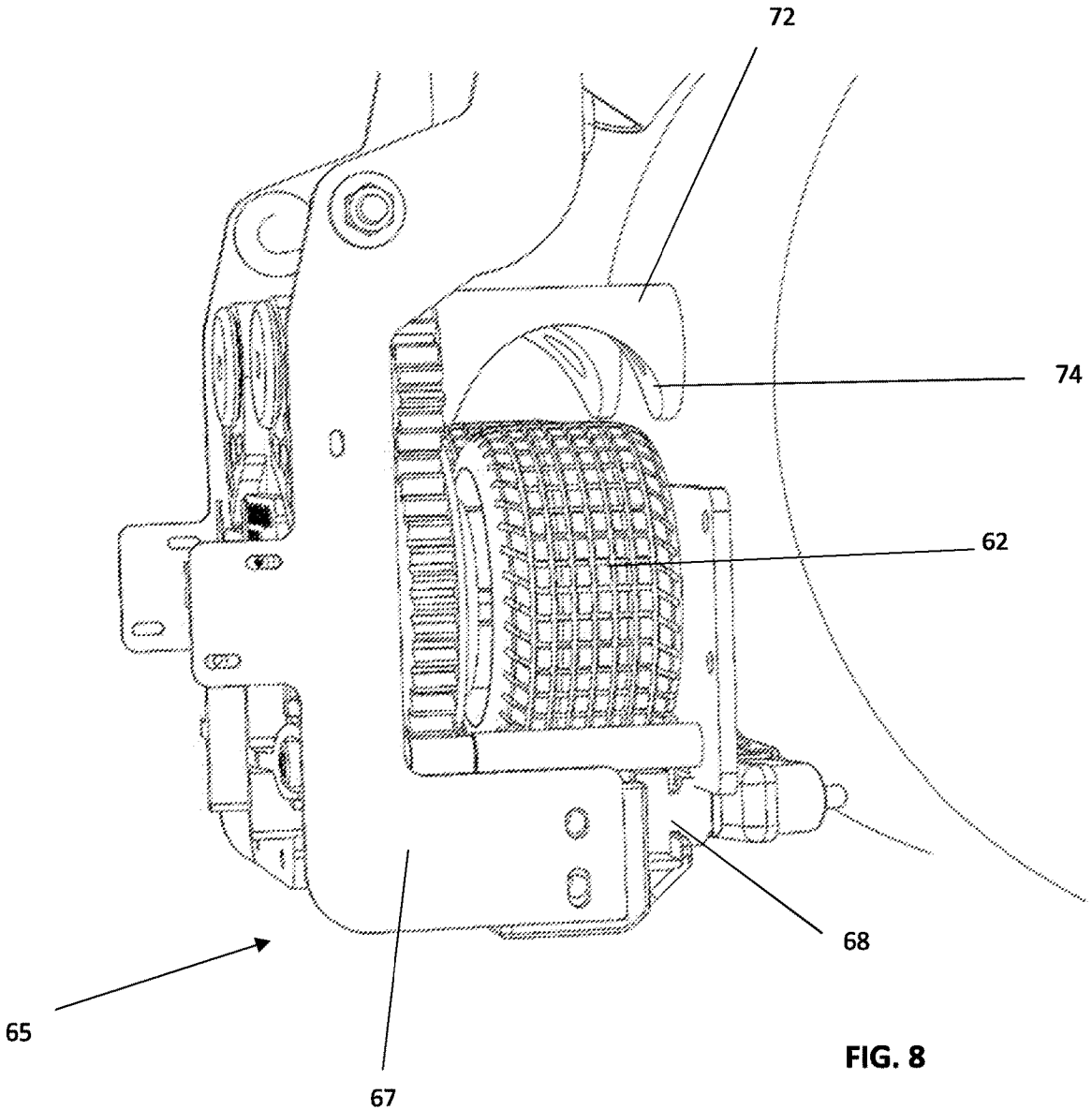
FIG. 8 is a close-up perspective view, showing the movable arm of the second heat sealing device in a closed position, pressing against the device's heated electric wire.

In the apparatus 10, as shown in FIGS. 7 and 8, a widthwise-elongated, second heating device 65 may be provided below the second rollers 62 and the open bottom end 64 of the pipe 40. The second heating device 65 may heat seal opposite widthwise sides of the top of the tube 28, formed by the second lengthwise portion 26 of the sheet 14, along substantially the entire width of top portions of the tube 28 above the product within the tube 28. Optionally, the second heating device 65 may have a widthwise, heated electric wire 65A that is intermittently brought into contact with the top portions of the tube 28 above its product. Also, the second heating device 65 may intermittently press opposite widthwise sides of the top portions of the tube 28 together to enhance the heat seal of the tube 28. In this regard, the electric wire 65A of the second heating device 65 may be mounted on the frame 66 of the apparatus 10, and the frame 66 may be provided with an arm 67, which may be pivotally mounted on the frame 66, which may have a pressure bar 68 on one end 69, and the end 69 of which can be moved towards and away from the electric wire of the second heating device. This allows the second heating device 65 to form a heat seal 71 at the top of the plastic tube 28 and thereafter release the top of the tube 28 to allow it, together with the product in the tube 28, to move further downwardly, away from the bottom end 64 of the pipe.

Thereby, the apparatus 10 forms the tube 28, formed by the second lengthwise portion 26 of the sheet 14, into a finally-sealed, tubular plastic container 70 containing a product. The finally-sealed, tubular plastic container 70 may be produced as one container 70 in a continuous string of finally-sealed tubular plastic containers 70, each containing a product which cannot leak out of its container.

In additional implementations, the first and second heating devices 60 and 65 can be replaced by other devices for sealing portions of the sheet 14 of film to each other. For example, such alternative sealing devices could each include a source of an adhesive for bonding together the portions of the sheet 14 and a device for curing or otherwise activating the adhesive between the portions of the sheet, as well as a device for pressing together the portions of the sheet.

In further implementations, the second heating device 65 can include two, vertically-separate, widthwise, heated electric wires, so that the heating device can form a pair of parallel heat seals 71 at the top portions of each plastic tube (e.g., 28 and 32). This would permit the resulting adjacent finally-sealed, tubular plastic containers to be separated (e.g., by cutting the sheet of film 14 between the heat seals 71 of the containers 70).

As shown in FIGS. 4 and 6-8, the apparatus 10 may also include a third pair of opposed rotating mating rollers 72 that are above the second rollers 62 and that rotate widthwise beneath the open bottom end 64 of the pipe 40. The third rollers 72 may be adjacent, and parallel to, the second rollers 62. The third rollers 72, may be made of a rigid material, such as steel, and may be on opposite widthwise sides of the tube 28, formed by the second lengthwise portion of the sheet 14, and of the product within the tube 28. The third rollers 72 may contact opposite widthwise sides of the outer surface of the tube 28. The third rollers 72 have mating semi-circular apertures 74 which are centred along the length of the third rollers and can physically engage any product as it passes downwardly in the tube 28 between the third rollers. As a result, the apertures 74 in the third rollers 72 urge the product to move downwardly in the tube with rotation of the third rollers. The third rollers 72 are also biased, such as by a spring 76, against opposite widthwise sides of the tube 28, so that the third rollers and their apertures 74 can reversibly move widthwise apart when urged by the size of the product in the tube 28 between the third rollers. As a result, the apertures 74 in the third rollers 72 can move the product through the tube 28, downwardly away from the open bottom end 64 of the pipe 40, without the product accumulating in the tube above the third rollers and thereby obstructing the pipe 40.

The rollers 58, 62 and 72 of the apparatus 10 can be driven in various ways, such as by electric motors. Likewise, the heat sealing devices 60 and 65 of the apparatus 10 can be powered in various ways, such as by a source of electricity. The apparatus 10 and its motors and its heat sealing devices 60 and 65 can be actuated in various ways, such as by a start/stop button, which can be pushed by a user each time a product is to be wrapped in a plastic tube 28. Alternatively, the apparatus 10 and its motors and its heat sealing devices 60 and 65 can be actuated by an optical sensor that is adjacent to the open top end 50 of the pipe 40 and that can sense the insertion of a product into the open top end 50 of the pipe 40.

The apparatus of this disclosure can be used in a process for packaging a product, such as a waste product, in a finally-sealed tubular plastic container 70:

providing a source 20, such as a roll, of a sheet 14 of a plastic, such as a thermoplastic, film having a first lengthwise portion 24; the sheet also having a second lengthwise portion 26, spaced lengthwise away from the first lengthwise portion, with a pair of second widthwise end portions 56, 56A on opposite sides of the second lengthwise portion;

the sheet further having a third lengthwise portion 28 which is spaced lengthwise further away from the first lengthwise portion than the second lengthwise portion, which has a tubular form and opposite widthwise sides of which have been heat sealed together along substantially the entire connection of the second and third lengthwise portions;

moving the second lengthwise portion 26 of the sheet away from the source 20 and about an open-ended, vertically-extending tubular pipe 40 and then toward an open top end 50 of the pipe to form the second lengthwise portion of the sheet into a tubular form 52 around the pipe 40 with the second widthwise end portions overlapping each other;

heat sealing the overlapping second widthwise end portions 56, 56A of the second lengthwise portion of the sheet to each other, such as while pressing the overlapping second widthwise end portions against an exterior surface 46 of the pipe 40, to form the second lengthwise portion of the sheet into a plastic tube 28;

moving the tube 28, formed by the second lengthwise portion 26 of the sheet 14, into an open top end 50 of the pipe 40, such as with first opposed rotating rollers that are on opposite sides of, frictionally engage, the tube 28 and then downwardly in the pipe, so that the interior of the tube, formed by the second lengthwise portion of the sheet, is open at the top end of the pipe;

placing the product into the interior of the tube 28, formed by the second lengthwise portion of the sheet, at the open top end 50 of the pipe 40, so that the product then falls downwardly through the tube, formed by the second lengthwise portion of the sheet, and the pipe to the heat sealed top portions of the third lengthwise portion 28 of the sheet;

moving the tube 28, formed by the second lengthwise portion of the sheet, further downwardly through, and outwardly of, the pipe 40, such as with second opposed rotating rollers 62 that are on opposite sides of, frictionally engage, the tube; and then heat sealing together opposite widthwise sides of top portions of the tube 28, formed by the second lengthwise portion 26 of the sheet 14, along substantially the entire width of the top of the tube, formed by the second lengthwise portion of the sheet.

In additional implementations of the process and apparatus of this disclosure, two or more sheets 14 of the plastic film can be formed into a sealed tubular plastic container 70. This can be done by unwinding a second lengthwise portion 26 of each sheet of film surrounding an open-ended, vertically-extending tubular pipe 40, such as from a separate source of film, which in some implementations may be a separate roll 20 of film. Each roll 20 may be adjacent to, and has its axis 21 tangential to, the pipe 40. The second lengthwise portion 26 of each sheet may be unwound lengthwise, relative to the sheet, from its roll and upwardly towards the pipe 40 adjacent to the roll. In this regard, the second lengthwise portion 26 of each sheet may be moved away from the roll and initially up to and over a separate forming shoulder 42, extending widthwise relative to the sheet, and then moved downwardly beneath a separate mandrel 44. The mandrel 44 for each sheet may be adjacent to, and surround, a part of the tubular outer surface 46 of the pipe 40 and extend lengthwise away from the forming shoulder 42 for the sheet. The mandrels 44 for the two or more sheets may be symmetrical about the pipe 40. Each mandrel 44 may have a lower forming surface 48, against which the second lengthwise portion 26 of a sheet is moved downwardly from its forming shoulder 42 towards the bottom 49 of the lower forming surface 48 of the mandrel 44 to the tubular outer surface 46 of the pipe 40. At the bottom 49 of the lower forming surfaces 48 of the mandrels 44, the second lengthwise portions 26 of the sheets may be moved upwardly together around the pipe 40 and towards its open top end 50, whereby the second lengthwise portions 26 together may be provided with a tubular form 52 around, and adjacent to, the outer surface 46 of the pipe. The widthwise ends of the mandrels 44 may overlap, so that the widthwise end portions 56, 56A on opposite sides of the second lengthwise portion 26 of each sheet 14 overlap the widthwise end portions 56, 56A on opposite sides of the second lengthwise portion 26 of one or more other sheets 14 in the tubular form 52 of the second lengthwise portions 26 of the sheets around the pipe. Then, two or more, first heating devices 60, adjacent to the tubular outer surface 46 of the pipe 40 and above a first pair of opposed rotating mating rollers 58, may heat seal the overlapping widthwise end portions 56, 56A on opposite sides of the second lengthwise portions 26 of the one or more other sheets 14 to each other. Thereby, the first heating devices 60 may make the tubular form 52 of the second lengthwise portions 26 of the sheets 14 into a plastic tube 28. In some implementations, each first heating device 60 is a downwardly-extending electric wire that continuously contacts a pair of overlapping widthwise end portions 56, 56A of second lengthwise portions 26 of two sheets 14 as they move together moved upwardly from the bottom 49 of each lower forming surface 48 of one of the mandrels 44 toward the open top end 50 of the pipe. Optionally, each first heating device 60 also presses a pair of overlapping widthwise end portions 56, 56A of second lengthwise portions 26 of two sheets 14 against the outer surface 46 of the pipe to enhance the heat seal of the tube 28.

The present disclosure also relates to an apparatus for packaging a product, such as a waste product, in a sealed tubular plastic container; the apparatus, in some implementations, may comprise:

a holder for providing of a sheet of a plastic, such as a thermoplastic, film, the sheet having:

a first lengthwise portion, a second lengthwise portion, spaced lengthwise away from the first lengthwise portion, and a third lengthwise portion which is spaced lengthwise further away from the first lengthwise portion than the second lengthwise portion;

an open-ended, vertically-extending tubular pipe adjacent to the source;

a mandrel between an outer surface of the pipe and the source, adapted to form the second lengthwise portion of the sheet into a tubular form around the pipe with the second widthwise end portions overlapping each other when the second lengthwise portion is moved away from the source along the mandrel toward the outer surface of the pipe and then toward an open top end of the pipe; and a first sealing device, such as a heating device, adjacent to an exterior surface of the pipe, for sealing, such as heat sealing, to each other the overlapping second widthwise end portions of the tubular form of the second lengthwise portion of the sheet, such as while pressing the overlapping second widthwise end portions against the exterior surface of the pipe, to form the tubular form of the second lengthwise portion of the sheet into a plastic tube.

The present disclosure also relates to a kit of parts, which in some implementations may comprise an apparatus as set out herein above and a roll of a sheet of the plastic film wound about the axis of the roll for use with the apparatus.

Some implementations of the present apparatus, kit of parts and process may advantageously make use of relatively simple thermoplastic films and may also avoid direct contact of waste products with parts of the apparatus, otherwise necessitating a regular cleaning and/or disinfection of this contact surface. In such implementations, the waste product rather may essentially only be placed in contact with the film surface that forms the internal surface of the packaging and may get sealed into the film.

As such, some implementations of the apparatus and process are particularly useful for handling and discarding dangerous waste products such as clinical waste or the like into an essentially hermetically sealed packaging, which can be discarded directly, and does not exhibit any surface that was exposed to the waste products.

The invention claimed is:

1. An apparatus for packaging a product in a sealed tubular plastic container, the apparatus comprising:

a source of a sheet of a plastic film having a first lengthwise portion, the sheet of plastic film also having a second lengthwise portion spaced lengthwise away from the first lengthwise portion, the sheet of plastic film further having a third lengthwise portion spaced lengthwise further away from the first lengthwise portion than the second lengthwise portion, the second lengthwise portion having a tubular form that includes opposite widthwise sides of which have been sealed together along substantially an entire width of a top of the third lengthwise portion;

an open-ended, vertically-extending tubular pipe adjacent to the source;

a mandrel between an outer surface of the pipe and the source and adapted to form the second lengthwise portion of the sheet into the tubular form around the pipe with the opposite widthwise end portions overlapping each other when the second lengthwise portion is moved away from the source along the mandrel toward the outer surface of the pipe and then toward an open top end of the pipe;

a first sealing device adjacent to the outer surface of the pipe and adapted for sealing, to each other, the overlapping second widthwise end portions of the tubular form of the second lengthwise portion of the sheet to form the sheet of plastic film into a plastic tube with the pipe at an interior of the plastic tube;

first opposed rotating rollers that are on opposite widthwise sides of an exterior of the plastic tube and that are adapted to frictionally engage and move the plastic tube toward the open top end of the pipe;

second opposed rotating rollers that are on opposite widthwise sides of the plastic tube formed by the second lengthwise portion of the sheet, that are below an open bottom end of the pipe and that are adapted to frictionally engage and move the second and third lengthwise portions downwardly and thereby move the second lengthwise portion away from the source and move the plastic tube into the open top end of the pipe and then downwardly to and through the open bottom end of the pipe, so that the interior of the plastic tube, formed by the second lengthwise portion of the sheet, is open at the top end of the pipe; and a second sealing device below the pipe and adapted for sealing, to each other, opposite widthwise sides of a top portion of the plastic tube along substantially an entire width of the top portion of the plastic tube, and thereby enclosing the product in the plastic tube.

2. The apparatus of claim 1, wherein the source is a roll of the sheet of the plastic film wound about an axis of the roll.

3. The apparatus of claim 1, further comprising:

third opposed rotating rollers that are above the second rollers and that are on opposite widthwise sides of the plastic tube formed by the second lengthwise portion of the sheet, the third rollers being adapted to move the product within the plastic tube downwardly out of and away from the bottom of the pipe, the third rollers having mating semi-circular apertures that are adapted to engage the product as it passes downwardly in the plastic tube between the third rollers, the mating semi-circular apertures in the third rollers being adapted to urge the product to move downwardly in the plastic tube with rotation of the third rollers.

4. The apparatus of claim 3, wherein the third rollers are biased against opposite widthwise sides of the plastic tube so that the third rollers and their apertures can reversibly move widthwise apart when urged by the size of the product in the plastic tube between the third rollers.

5. The apparatus of claim 1, wherein at least one of the first and second sealing devices comprises a device for heat sealing.

6. A process for packaging a product in a sealed tubular plastic container, the process comprising the steps of:

providing a source of a sheet of a plastic film having a first lengthwise portion, the sheet of plastic film also having a second lengthwise portion spaced lengthwise away from the first lengthwise portion, the sheet further having a third lengthwise portion spaced lengthwise further away from the first lengthwise portion than the second lengthwise portion, the second lengthwise portion having a tubular form that includes opposite widthwise sides of which have been sealed together along substantially an entire connection of the second and third lengthwise portions;

moving the second lengthwise portion of the sheet away from the source and about an open-ended, vertically-extending tubular pipe and then toward an open top end of the pipe to form the second lengthwise portion of the sheet into the tubular form around the pipe with the second widthwise end portions overlapping each other;

sealing the overlapping second widthwise end portions of the second lengthwise portion of the sheet to each other to form the second lengthwise portion of the sheet of plastic film into a plastic tube with the pipe at an interior of the plastic tube;

moving the plastic tube into the open top end of the pipe with first opposed rotating rollers that are on opposite sides of and frictionally engage the plastic tube and then downwardly through the pipe so that the interior of the plastic tube formed by the second lengthwise portion of the sheet is open at the top end of the pipe;

placing the product into the plastic tube formed by the second lengthwise portion of the sheet at the open top end of the pipe so that the product then falls downwardly through the plastic tube formed by the second lengthwise portion of the sheet and the pipe to a sealed top of the third lengthwise portion of the sheet of plastic film;

moving the plastic tube formed by the second lengthwise portion of the sheet further downwardly through and outwardly of the pipe with second opposed rotating rollers that are on opposite sides of and frictionally engage the plastic tube; and sealing to each other opposite widthwise sides of a top portion of the plastic tube formed by the second lengthwise portion of the sheet along substantially an entire width of the top portion of the plastic tube to enclose the product in the plastic tube.

7. The process of claim 6, wherein the source is a roll of the sheet of the plastic film wound about an axis of the roll.

8. The process of claim 6, further comprising:

engaging the product in the plastic tube formed by the second lengthwise portion of the sheet after the plastic tube has been moved downwardly through the pipe, between third opposed rotating rollers that are above the second rollers and that have mating semi-circular apertures, which urge the product to move downwardly in the plastic tube with rotation of the third rollers.

9. The process of claim 8, further comprising:

biasing the third rollers against opposite widthwise sides of the tube so that the third rollers and their apertures can reversibly move widthwise apart when urged by the size of the product in the tube between the third rollers.

10. The process of claim 6, wherein at least one of the sealing steps comprises heat sealing.

* * * * *